US010084262B2

(12) United States Patent
Kelly et al.

(10) Patent No.: US 10,084,262 B2
(45) Date of Patent: Sep. 25, 2018

(54) BI-DIRECTIONAL CABLE INTERCONNECT SYSTEM

(71) Applicant: Western Digital Technologies, Inc., Irvine, CA (US)

(72) Inventors: Noah Kelly, Houghton, MI (US); Todd Christopher McNally, Peyton, CO (US); Jeffrey David Wilke, Palmer Lake, CO (US)

(73) Assignee: Western Digital Technologies, Inc., Irvine, CA (US)

( * ) Notice: Subject to any disclaimer, the term of this patent is extended or adjusted under 35 U.S.C. 154(b) by 31 days.

(21) Appl. No.: 15/392,938

(22) Filed: Dec. 28, 2016

(65) Prior Publication Data

US 2018/0183183 A1 Jun. 28, 2018

(51) Int. Cl.

| | |
|---|---|
| ***H01R 13/631*** | (2006.01) |
| ***H01R 12/70*** | (2011.01) |
| ***H01R 13/639*** | (2006.01) |
| ***H01R 24/60*** | (2011.01) |
| ***H01R 43/18*** | (2006.01) |
| ***H01R 43/20*** | (2006.01) |
| *H01R 107/00* | (2006.01) |

(52) U.S. Cl.

CPC ..... *H01R 13/6315* (2013.01); *H01R 12/7011* (2013.01); *H01R 13/6395* (2013.01); *H01R 24/60* (2013.01); *H01R 43/18* (2013.01); *H01R 43/205* (2013.01); *H01R 2107/00* (2013.01)

(58) Field of Classification Search

CPC ..... H01R 13/6315; H01R 12/7011; H01R 13/6395; H01R 24/60

USPC ..... 439/78

See application file for complete search history.

(56) References Cited

U.S. PATENT DOCUMENTS

| | | | | | |
|---|---|---|---|---|---|
| 4,624,516 | A * | 11/1986 | White | H01R 13/516 | 439/136 |
| 5,118,311 | A * | 6/1992 | Margini | H01R 13/639 | 439/344 |
| 5,174,762 | A * | 12/1992 | Hoppal | H05K 7/1429 | 439/61 |
| 8,102,648 | B2 | 6/1995 | Grabher | | |
| 6,238,251 | B1 * | 5/2001 | Curtis | H01R 13/62933 | 439/344 |
| 6,241,546 | B1 * | 6/2001 | Lee | H01R 13/743 | 439/344 |
| 6,364,536 | B1 * | 4/2002 | Chen | G02B 6/3825 | 385/59 |
| 6,406,192 | B1 * | 6/2002 | Chen | H01R 13/6315 | 385/56 |
| 6,426,882 | B1 | 7/2002 | Sample | | |

(Continued)

*Primary Examiner* — Alexander Gilman

(57) ABSTRACT

In general, embodiments of a bi-directional cable interconnect system are described. A connector bezel configured to guide engagement of a male mating connector of a cable with a female mating connector comprises a front plate having a main opening formed therein configured to allow passage of the male mating connector therethrough and a rear assembly attached to the front plate. The rear assembly comprises a plurality of walls forming a cable connector opening therethrough and a rear opening formed in the rear assembly configured to allow passage of the female mating connector therethrough. The cable connector opening is fluidly coupled with the main opening and with the rear opening.

21 Claims, 6 Drawing Sheets

(56) References Cited

U.S. PATENT DOCUMENTS

| | | | | |
|---|---|---|---|---|
| 6,964,525 | B2 * | 11/2005 | Ohtsuka | G02B 6/3834 385/78 |
| 7,318,740 | B1 * | 1/2008 | Henry | H01R 13/6275 439/352 |
| 7,375,960 | B2 | 5/2008 | Young et al. | |
| 7,581,978 | B1 * | 9/2009 | Briant | H01R 13/6275 439/358 |
| 7,762,817 | B2 | 7/2010 | Ligtenberg et al. | |
| 7,958,273 | B2 | 6/2011 | El-Batal | |
| 8,057,249 | B1 * | 11/2011 | Tobey | H01R 13/741 439/345 |
| 8,465,311 | B2 * | 6/2013 | Takamatsu | G02B 6/3821 439/247 |
| 8,961,031 | B2 * | 2/2015 | Gurreri | G02B 6/3831 385/58 |
| 8,988,870 | B2 | 3/2015 | Goodwin et al. | |
| 9,419,367 | B2 * | 8/2016 | Henry | H01R 9/034 |
| 2006/0025018 | A1 * | 2/2006 | Dube | H01R 23/68 439/628 |
| 2013/0171885 | A1 * | 7/2013 | Zhang | H01R 13/6471 439/676 |
| 2013/0237092 | A1 * | 9/2013 | Rubens | H01R 13/6596 439/607.23 |
| 2015/0207246 | A1 * | 7/2015 | Lewis | H01R 13/506 439/62 |
| 2016/0126660 | A1 * | 5/2016 | Henry | H01R 13/506 439/606 |
| 2016/0218455 | A1 * | 7/2016 | Sayre | H01R 13/6594 |
| 2016/0233615 | A1 * | 8/2016 | Scholeno | H01R 12/712 |
| 2016/0380383 | A1 * | 12/2016 | Lord | H01R 12/716 439/374 |

* cited by examiner

BI-DIRECTIONAL CABLE INTERCONNECT SYSTEM

TECHNICAL FIELD

The disclosure relates to cable interconnects for electrical cables.

TECHNICAL BACKGROUND

In a data center environment, cables are the main method of interconnect between systems. Service and usability of the systems are an ongoing concern. A typical data center may have one or more "hot" aisles and one or more "cold" aisles adjacent to the system equipment. To cool the equipment running in the data center, airflow is created from the cold aisle through the equipment to the hot aisle. The hot air in the hot aisle is then directed to be cooled via an air cooling unit for supply back to the cold aisles, or the hot air can be vented into the ambient environment outside of the space in which the equipment is housed.

Servicing of the data center equipment typically has to occur from both hot and cold aisles. The equipment may be inserted into a rack system or other structure designed to house the equipment from the cold aisle side, and the data and other cables to be connected to the equipment are typically coupled to the equipment from the hot aisle side. Because of the amount of heat generated by the data center equipment, the temperature in the hot aisle can be very uncomfortable for the technician or other personnel tasked to be in the hot aisle to connect or disconnect cabling from the equipment.

Overview

In one example, the disclosure is directed to a connector bezel configured to guide engagement of a male mating connector of a cable with a female mating connector. The connector bezel comprises a front plate having a main opening formed therein configured to allow passage of the male mating connector therethrough and a rear assembly attached to the front plate. The rear assembly comprises a plurality of walls forming a cable connector opening therethrough and a rear opening formed in the rear assembly configured to allow passage of the female mating connector therethrough. The cable connector opening is fluidly coupled with the main opening and with the rear opening.

In another example, the disclosure is directed to a method of manufacturing a connector bezel comprises forming a main opening in a front plate, the main opening configured to allow passage of the male mating connector therethrough and attaching a plurality of walls to the front plate. The plurality of walls forming a cable connector opening fluidly coupled with the main opening. The method also comprises forming a rear opening configured to allow passage of the female mating connector therethrough, the rear opening fluidly coupled with the cable connector opening.

In another example, the disclosure is directed to a cable interconnect system comprises an electrical cable comprising a male connector, a circuit board, and a female connector attached to the circuit board and configured to mate with the male connector. The cable interconnect system also comprises a connector bezel comprising a front plate having a main opening formed therein configured to allow passage of the male connector therethrough and a rear assembly attached to the front plate. The rear assembly comprises a plurality of walls forming a cable connector opening therethrough and a rear opening formed in the rear assembly configured to allow passage of the female connector therethrough. The cable connector opening is fluidly coupled with the main opening, and the rear opening is fluidly coupled with the cable connector opening.

The details of one or more examples of the disclosure are set forth in the accompanying drawings and the description below. Other features, objects, and advantages of the disclosure will be apparent from the description and drawings, and from the claims.

BRIEF DESCRIPTION OF THE DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

DETAILED DESCRIPTION

The following description and associated figures teach the best mode of the invention. For the purpose of teaching inventive principles, some conventional aspects of the best mode may be simplified or omitted. The following claims specify the scope of the invention. Note that some aspects of the best mode may not fall within the scope of the invention as specified by the claims. Thus, those skilled in the art will appreciate variations from the best mode that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
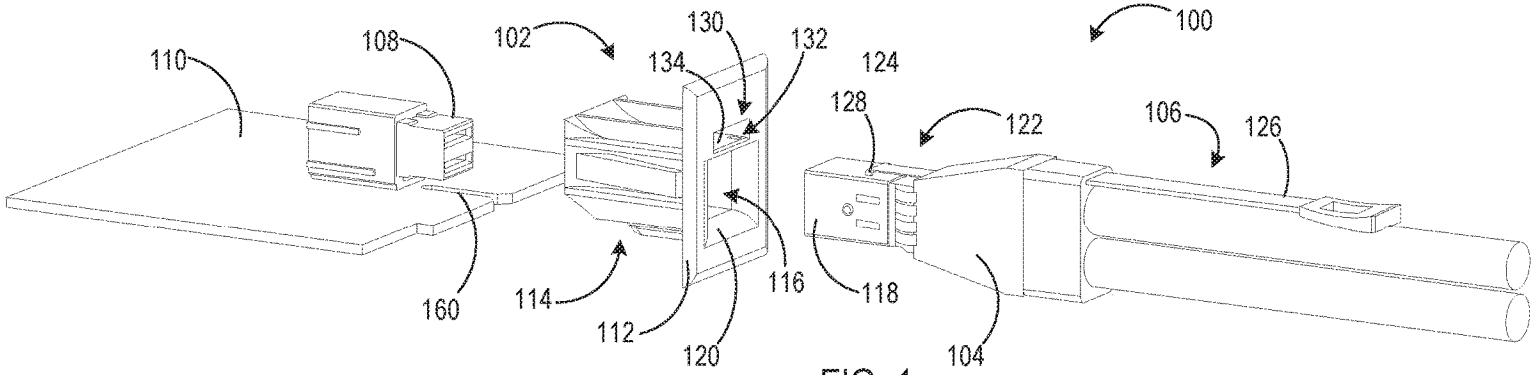
FIG. 1 is an isometric view of a bi-directional cable interconnect system in accordance with one or more embodiments of this disclosure.

FIG. 1 illustrates a bi-directional cable interconnect system 100 in accordance with one or more embodiments of this disclosure. Cable interconnect system 100 includes a connector bezel or clip 102 configured to guide engagement of a male mating connector 104 of an electrical cable 106 with a female mating connector 108 coupled to a circuit board 110 or other supporting member. The male and female mating connectors 104, 108 are configured to electrically couple together to exchange data, power, or other signals therebetween. In the exemplary embodiments disclosed herein, cable 106, male mating connector 104, and female mating connector 108 are illustrated and described as being of the Serial-Attached Small Computer System Interface (SAS) cable type, and connector bezel 102 is described as being configured to guide the attachment thereof. However, the design configuration of connector bezel 102 is not limited only to the SAS cable type. The connector bezel 102 may be designed for other cable connector types such as miniSAS, miniSAS HD, Ethernet, serial, RS232, small form-factor pluggable (SFP), SFP+, quad small form-factor pluggable (QSFP), and QSFP+ connectors. Additional connector types known in the art are also considered within the scope of this disclosure.

Figure 2:
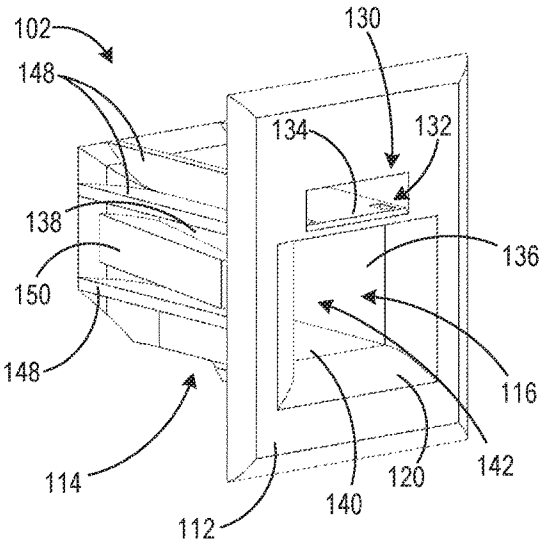
FIG. 2 is an isometric view of a front portion of the connector bezel of FIG. 1 in accordance with one or more embodiments of this disclosure.
Figure 3:
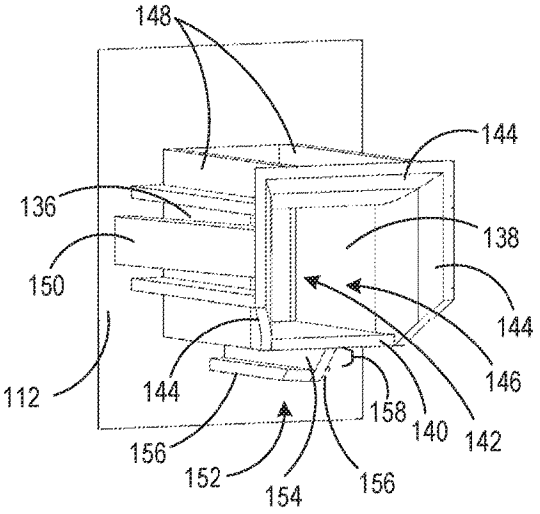
FIG. 3 is an isometric view of a rear portion of the connector bezel of FIG. 1 in accordance with one or more embodiments of this disclosure.

Referring to FIGS. 1-3, connector bezel 102 includes a front plate 112 attached to a rear assembly 114. Front plate 112 has a main opening 116 configured to allow insertion of the end portion 118 of male mating connector 104 thereinto. A plurality of bevel surfaces 120 formed in front plate 112 about main opening 116 help to guide end portion 118 into main opening 116. Bevel surfaces 120 may be curved (as shown) or may be planar or convexly curved to direct end portion 118 into main opening 116. In one embodiment, connector bezel 102 is formed of a polymer or plastic material. However, other materials such as metals may also be used.

As illustrated in FIG. 1, cable 106 has a locking assembly or mechanism 122 that includes a lock member 124 typically elastically or spring biased toward end portion 118 and a release assembly 126 configured to cause the lock member 124 to extend or pull away from the face of the end portion 118 when actuated. Lock member 124 includes one or more locking elements 128 configured to secure male mating connector 104 to the mechanism into which it is inserted. As shown herein, locking elements 128 comprise teeth. However, other types of locking elements are contemplated such as a locking tab. A typical female connector (not shown) for male mating connector 104 includes an outer wall or shield (often formed of metal) having openings formed therein for engaging lock member 124 to lock male mating connector 104 with the female connector to avoid unintentional disengagement without manipulation of the locking mechanism 122. Embodiments of the invention allow remote coupling or engagement of the female mating connector 108 with the male mating connector 104. As such, a locked engagement between the male and female mating connectors 104, 108 disclosed herein would be undesirable. Accordingly, a lock or locking opening 130 is formed in front plate 112 of connector bezel 102 to allow the insertion of lock member 124 thereinto. A plurality of tooth openings 132 formed in a top wall 134 of the rear assembly 114 allows the teeth 128 to secure male mating connector 104 to the connector bezel 102 rather than to the female mating connector 108.

Rear assembly 114 includes a plurality of side walls 136, 138 and a bottom wall 140 that, together with top wall 134, form a cable connector opening 142 into which male mating connector 104 couples with female mating connector 108. Extending at least from top and side walls 134-138 are beveled walls 144 to help guide, if needed, female mating connector 108 into a rear opening 146 that communicates via top, side, and bottom walls 134-140 with main opening 116 by way of the cable connector opening 142. As such, cable connector opening 142 is fluidly coupled to both main opening 116 and rear opening 146. A plurality of ribs 148 strengthen and stabilize front plate 112 and walls 134-144.

Figure 8:
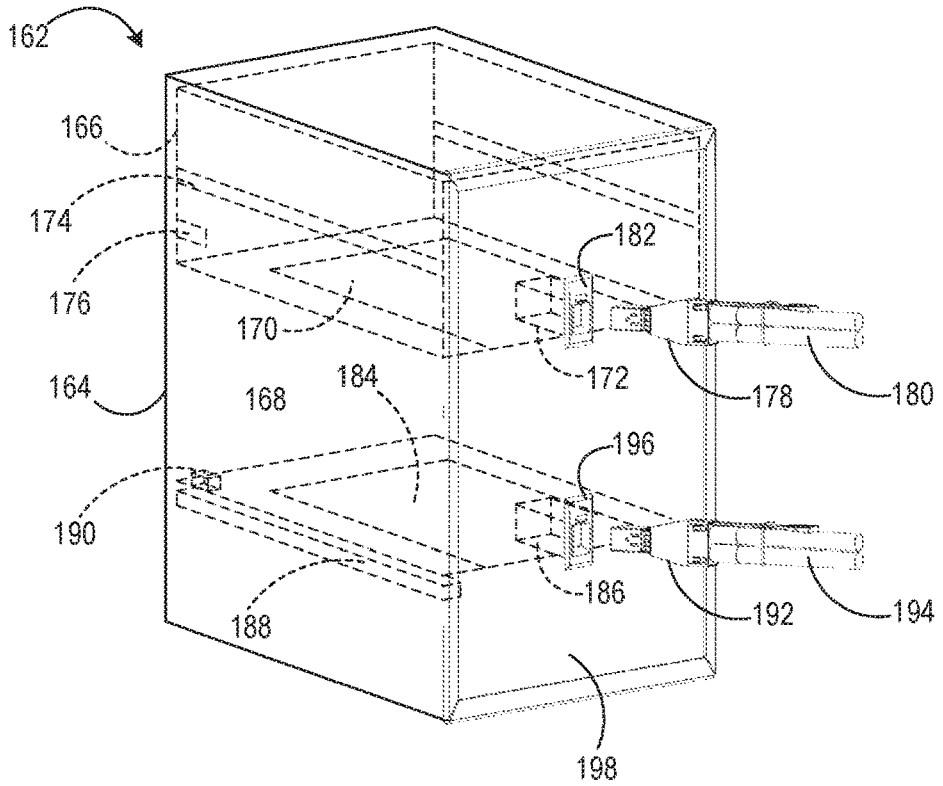
FIG. 8 illustrates a modular system incorporating embodiments of this disclosure in accordance with one or more embodiments of this disclosure.
Figure 9:
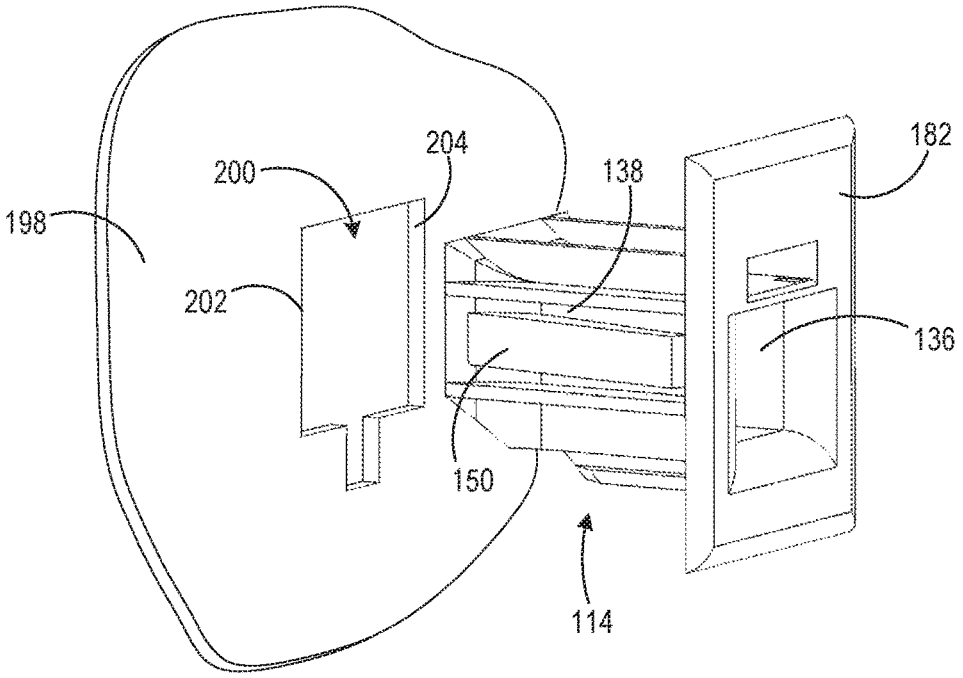
FIG. 9 is an isometric view showing the connector bezel of FIG. 8 in an insertion position in accordance with one or more embodiments of this disclosure.
Figure 10:
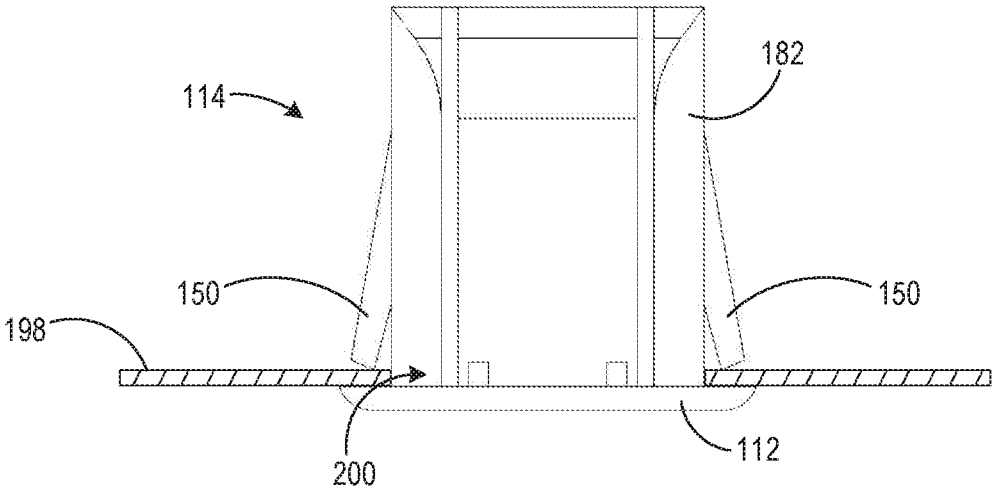
FIG. 10 is a top plan view showing the connector bezel of FIG. 8 inserted into the panel wall in accordance with one or more embodiments of this disclosure.

A plurality of flexible securing members 150 positioned adjacently to side walls 136, 138 secure connector bezel 102 to a panel wall (as illustrated and discussed in FIGS. 8-10). As described and shown herein, securing members 150 include flexible tabs that may be coupled to beveled walls 144 as shown or may be coupled to side walls 136, 138.

An alignment assembly 152 coupled to bottom wall 140 aids the alignment and insertion of female mating connector 108 into cable connector opening 142. Alignment assembly 152 includes a first wall 154 extending perpendicularly away from bottom wall 140. First wall 154 is coupled with bottom wall 140 and may additionally be coupled with front plate 112 for added stability. One or more circuit board support walls 156 extend from first wall 154 such that a gap 158 between circuit board support walls 156 and bottom wall 140 allows circuit board 110 to pass thereinto. A groove 160 formed in circuit board 110 is aligned with female mating connector 108 such that engagement of the circuit board 110 with the alignment assembly 152 via groove 160 during movement of circuit board 110 in an insertion or installation direction aligns the female mating connector 108 with the cable connector opening 142. Contrary to the ability of the male mating connector 104 to be locked with connector bezel 102, female mating connector 108 does not include locking hardware or elements able to directly engage female mating connector 108 with connector bezel 102 in a locking arrangement. Thus, removal of circuit board 110 away from connector bezel 102 in a removal or uninstallation direction opposite the insertion direction also removes female mating connector 108 from connector bezel 102 with resistance against uninstallation provided by a friction fit between male mating connector 104 and female mating connector 108. Further discussion of the engagement of circuit board 110 and alignment assembly 152 is found below in FIGS. 6 and 7.

Figure 4:
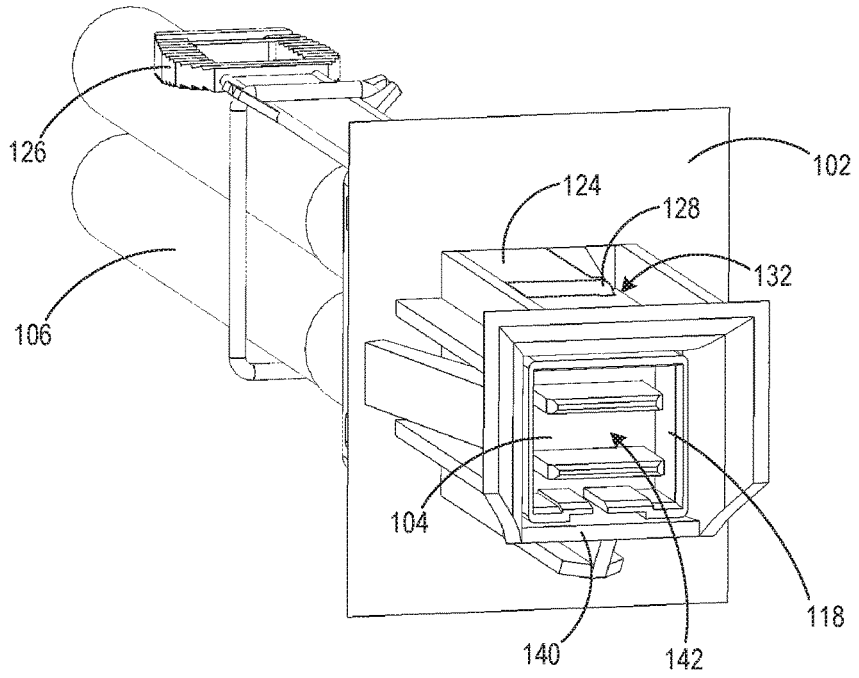
FIG. 4 is an isometric view of the male mating connector of FIG. 1 positioned within the connector bezel in accordance with one or more embodiments of this disclosure.

FIG. 4 is an isometric view of the male mating connector 104 of FIG. 1 positioned within the connector bezel 102. As illustrated, teeth 128 of lock member 124 are positioned within tooth openings 132 to create a locked engagement of cable 106 and male mating connector 104 with connector bezel 102. Pulling the release assembly 126 in a direction away from end portion 118 disengages teeth 128 from tooth opening 132 to allow removal of male mating connector 104 from connector bezel 102.

The end portion 118 of male mating connector 104 extends into cable connector opening 142, and in the embodiment shown, substantially traverses cable connector opening 142 to reach an end of the bottom wall 140. In this manner, male mating connector 104 may be fully engaged with female mating connector 108 (FIG. 1) when coupled therewith.

Figure 5:
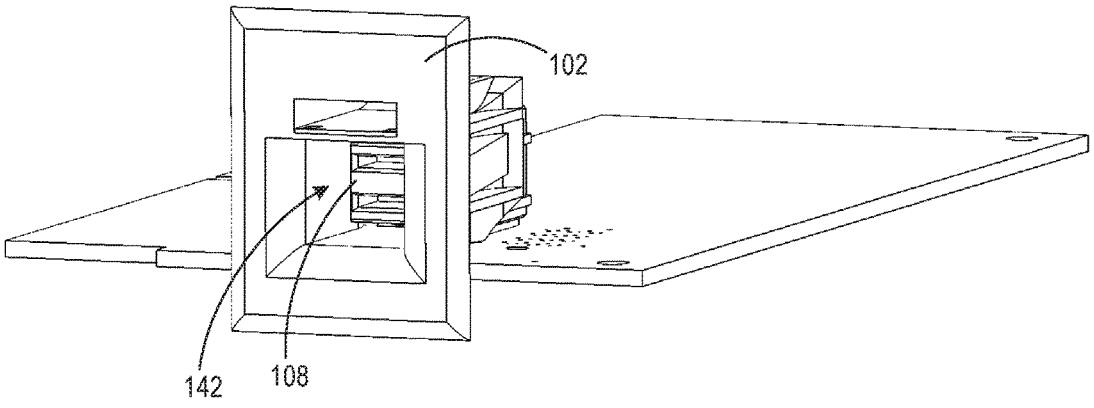
FIG. 5 is an isometric view of the female mating connector of FIG. 1 positioned within the connector bezel in accordance with one or more embodiments of this disclosure.

FIG. 5 is an isometric view of the female mating connector 108 of FIG. 1 positioned within the connector bezel 102. As illustrated, female mating connector 108 extends at least partially into cable connector opening 142 and may not extend fully thereinto. When combined with the insertion position of male mating connector 104 as shown in FIG. 4, male and female mating connectors 104, 108 are coupled together and can exchange the data, power, or other signals therebetween.

Figure 6:
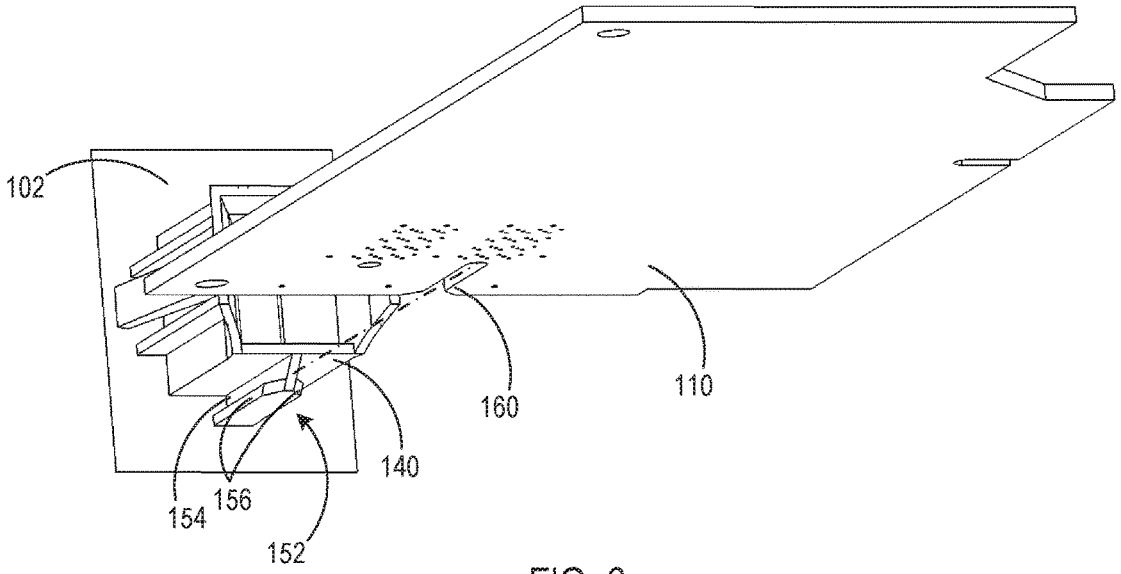
FIG. 6 is an isometric view showing the circuit board of FIG. 1 in an insertion position in accordance with one or more embodiments of this disclosure.
Figure 7:
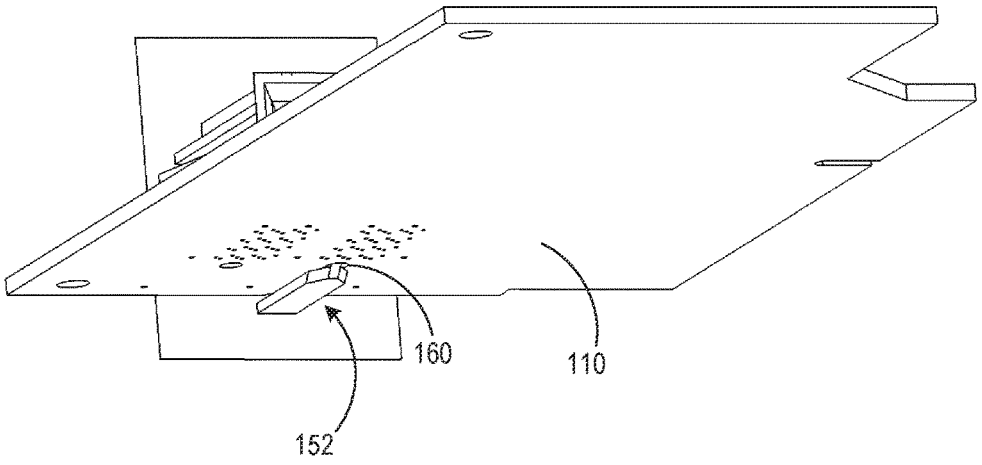
FIG. 7 is an isometric view showing the groove of the circuit board of FIG. 1 inserted into the alignment assembly of the connector bezel in accordance with one or more embodiments of this disclosure.

FIG. 6 illustrates an isometric view showing the circuit board 110 of FIG. 1 in an insertion position. In this position, groove 160 is aligned with first wall 154 of alignment assembly 152, and the circuit board 110 is vertically positioned to fit between circuit board support walls 156 and bottom wall 140. FIG. 7 illustrates an isometric view showing the groove 160 of the circuit board 110 inserted into the alignment assembly 152.

FIG. 8 illustrates a modular system 162 incorporating embodiments of this disclosure in accordance with one or more embodiments. Modular system 162 includes a cabinet or rack system 164 configured to house one or more modules 166, 168. Module 166 is shown as an enclosure housing a circuit board assembly 170 including a female mating connector 172. Module 166 may be inserted into cabinet 164 via a rail system 174, for example. Module 166 is locked into cabinet 164 via a cabinet locking system 176 that secures module 166 within cabinet 164 to prevent disengagement of female mating connector 172 from the male mating connector 178 of a cable 180 when both are inserted into the same connector bezel 182.

Module 168 is shown as an enclosure housing a circuit board assembly 184 having a female mating connector 186 coupled thereto. Module 164 may be inserted into cabinet 164 via one or more shelves 188 as shown or via a rail system such as rail system 174, for example. Similar to module 166, module 168 is locked into cabinet 164 via a cabinet locking system 190 that secures module 166 within cabinet 164 to prevent disengagement of female mating connector 172 from the male mating connector 192 of a cable 194 when both are inserted into the same connector bezel 196.

Once locked into their respective connector bezels 182, 196, male mating connectors 178, 192 remain connected thereto even during removal and insertion of modules 166, 168 into cabinet 164. Since female mating connectors 172, 186 are not locked to their respective connector bezels 182, 196, they travel with modules 166, 168 and are disengaged from connector bezels 182, 196 and male mating connectors 178, 192 when the entire module 166, 168 is removed from the cabinet 164. When modules 166, 168 are inserted into cabinet 164 and locked into place via cabinet locking systems 176, 190, female mating connectors 172, 186 are securely coupled to male mating connector 178, 192 and cannot be disengaged without removal of modules 166, 168 or detachment of male mating connectors 178, 192 from connector bezels 182, 196.

Cabinet 164 includes a panel wall or backplane 198 into which connector bezel 182, 196 are inserted. FIG. 9 illustrates a portion of panel wall 198 with a connector bezel such as connector bezel 182 in an insertion position in accordance with one or more embodiments of this disclosure. As shown, panel wall 198 includes a cutout or aperture 200 into which connector bezel 182 is inserted. A pair of side walls 202, 204 of cutout 200 are positioned to engage tabs 150 of connector bezel 182 to cause tabs 150 to flex toward side walls 136, 138 of connector bezel 182 during insertion. Referring as well to FIG. 10, when connector bezel 182 is seated into its installed position (preferably, with a rear side of front plate 112 butted against panel wall 198), tabs 150 are free to return to their unflexed state, causing connector bezel 182 to remain inserted into the cutout 200 and locked with the panel wall 198. To uninstall connector bezel 182 from the panel wall 198, tabs 150 are depressed to allow the rear assembly 114 of connector bezel 182 to be withdrawn from the cutout 200. Thus, when a force is applied to connector bezel 182 in an uninstallation direction without depressing or flexing tabs 150, tabs 150 will contact panel wall 198 and prevent removal of the 182 from the panel wall 198.

Figure 11:
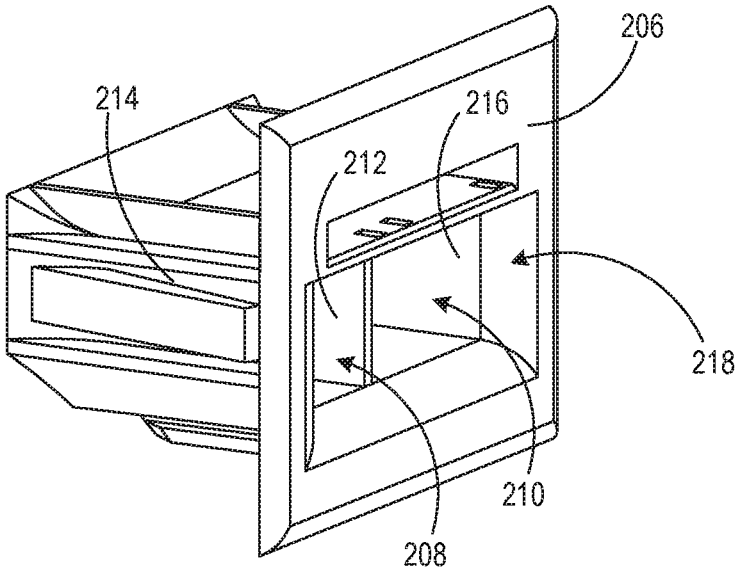
FIG. 11 is an isometric view showing a connector bezel with a plurality of cable connector openings in accordance with one or more embodiments of this disclosure.

FIG. 11 is an isometric view showing a connector bezel 206 with a plurality of cable connector openings 208, 210 in accordance with one or more embodiments of this disclosure. A divider wall 212 positioned between side walls 214, 216 separates the cable connector opening 218 into two openings to allow two male mating connectors to be installed side-by-side in a single bezel. While two cable connector openings 208, 210 are shown, embodiments of the invention contemplate additional openings arranged that may be arranged in a single row, a single column, or in a multi-row/multi-column arrangement.

Figure 12:
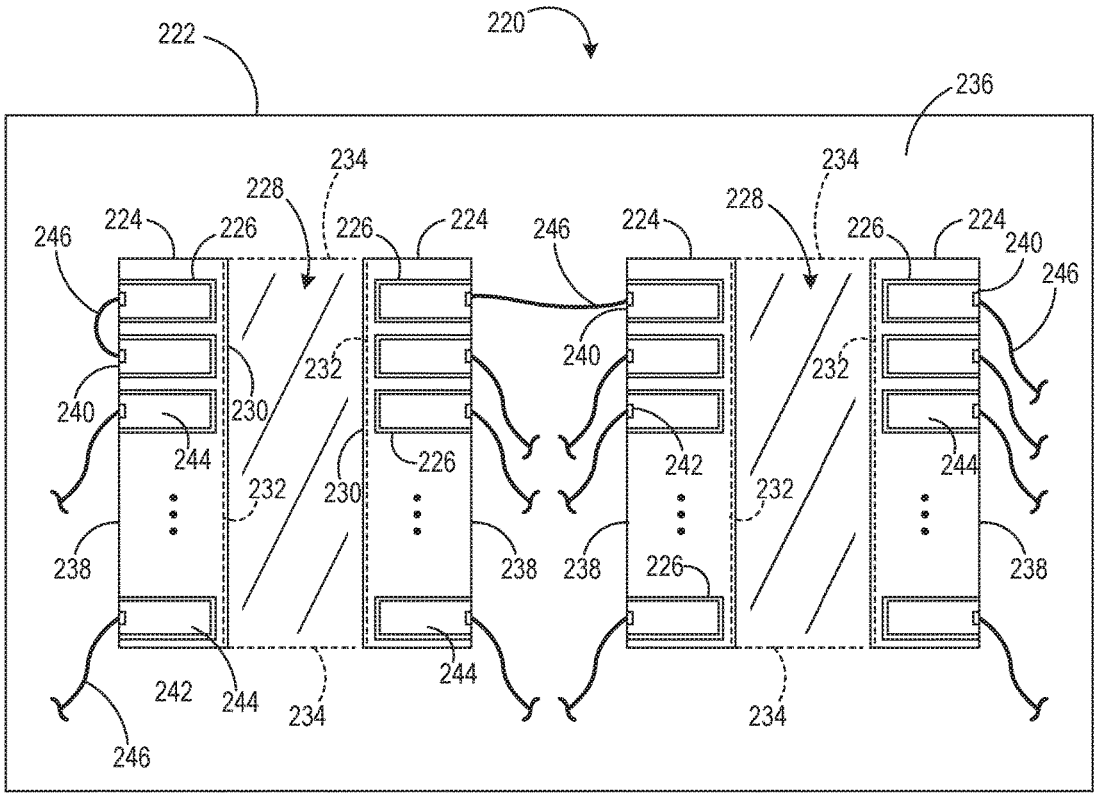
FIG. 12 is a block diagram showing a data center in accordance with one or more embodiments of this disclosure.

FIG. 12 is a block diagram showing a data center 220 in accordance with one or more embodiments of this disclosure. Data center 220 includes an equipment room 222 into which a plurality of modular systems 224 are installed. Each modular system 224 is designed to house a plurality of equipment modules 226 therein. Dual temperature aisles are created to provide cold air to cool the equipment and to remove and process hot air generated therefrom. A cold aisle 228 is created between opposing front faces 230 of adjacent modular systems 224. Cold air is provided to the cold aisle 228 to be drawn through the equipment to cool it. Cold aisle 228 may be isolated from other regions of the equipment room 222 by barriers such as curtains 232 and strip doors 234. A hot aisle 236 is created by causing the air heated by the equipment to be vented away from rear faces 238 of the modular systems 224 and into the areas of the equipment room 222 outside the cold aisles 228.

As shown, modular systems 224 include panel walls 240 having connector bezels 242 installed therein. Modules 226 mounted and installed in modular systems 224 have circuit boards 244 with female mating connectors as described herein. Cables 246 are connected to the female mating connectors as described above and modules 226 with other modules 226 or other equipment as needed.

Embodiments of the disclosure herein allow a technician performing maintenance on one or more modules 226 to spend less time exposed to the hot air in the hot aisles 236 by allowing disconnection of the modules 226 from the cables 246 from within the cold aisles 228. Additionally, since the female mating connector and corresponding cable connection are located adjacently to the hot aisle 236, internal re-routing to allow a cable connection from the front side near the cold aisle 228 may be avoided. Thus, a reduction of real estate within each module 226 due to such internal re-routing is avoided.

Various examples of the disclosure have been described. Any combination of the described systems, operations, or functions is contemplated. These and other examples are within the scope of the following claims.

What is claimed is:

1. A connector bezel configured to guide engagement of a male mating connector of a cable with a female mating connector, the connector bezel comprising:

a front plate having a main opening formed therein configured to allow passage of the male mating connector therethrough; and a rear assembly attached to the front plate, the rear assembly comprising:

a plurality of walls forming a cable connector opening therethrough;

a rear opening configured to allow passage of the female mating connector therethrough; and an alignment assembly configured to guide passage of the female mating connector into the rear opening, wherein the alignment assembly comprises:

a groove wall extending from a bottom wall of the plurality of walls; and a circuit board support wall extending from the groove wall such that a gap is formed between the circuit board support wall and the bottom wall;

wherein the cable connector opening is fluidly coupled with the main opening and with the rear opening.

2. The connector bezel of claim 1 wherein:

the front plate further has a lock opening formed therein configured to allow passage of a locking mechanism of the male mating connector therethrough; and the plurality of walls of the rear assembly comprises a top wall having at least one locking opening formed therein configured to accept a locking element of the locking mechanism thereinto after the locking mechanism is inserted through the lock opening.

3. The connector bezel of claim 2 wherein the locking element comprises a locking tooth.

4. The connector bezel of claim 1 wherein the rear assembly further comprises at least one flexible securing member configured to:

extend toward a panel wall of an enclosure when the connector bezel is installed in an opening of the panel wall; and contact the panel wall when a force is applied to the connector bezel in an uninstallation direction.

5. The connector bezel of claim 1 wherein:

the groove wall extends perpendicularly from the bottom wall; and the circuit board support wall extends perpendicularly from the groove wall.

6. The connector bezel of claim 1 wherein:

the plurality of walls comprises a divider wall positioned between a pair of side walls; and the divider wall separates the cable connector opening into at least two portions, each portion configured to allow passage of a respective male mating connector therethrough.

7. A method of manufacturing a connector bezel comprising:

forming a main opening in a front plate, the main opening configured to allow passage of a male mating connector therethrough;

attaching a plurality of walls to the front plate, the plurality of walls forming a cable connector opening fluidly coupled with the main opening;

forming a rear opening configured to allow passage of a female mating connector therethrough, the rear opening fluidly coupled with the cable connector opening; and forming a beveled surface between the main opening and the plurality of walls, the beveled surface configured to guide the male mating connector toward the cable connector opening.

8. The method of claim 7 further comprising forming a lock opening in the front plate, the lock opening configured to allow passage of a locking mechanism of the male mating connector therethrough.

9. The method of claim 8 further comprising forming a lock opening in a top wall of the plurality of walls, the lock opening configured to accept a locking element of the locking mechanism thereinto.

10. The method of claim 7 further comprising attaching a beveled wall to the plurality of walls, the beveled wall configured to guide the female mating connector toward the cable connector opening.

11. The method of claim 7 further comprising attaching a plurality of ribs to the front plate and to the plurality of walls, the plurality of ribs configured to stabilize the front plate with respect to the plurality of walls.

12. The method of claim 7 further comprising attaching an alignment assembly to a bottom wall of the plurality of walls, the alignment assembly configured to guide passage of a circuit board groove therealong.

13. A cable interconnect system comprising:

an electrical cable comprising a male connector;

a circuit board with a groove formed therein;

a female connector attached to the circuit board and configured to mate with the male connector; and a connector bezel comprising:

a front plate having a main opening formed therein configured to allow passage of the male connector therethrough; and a rear assembly attached to the front plate, the rear assembly comprising:

a plurality of walls forming a cable connector opening therethrough, the cable connector opening fluidly coupled with the main opening;

a rear opening configured to allow passage of the female connector therethrough, the rear opening fluidly coupled with the cable connector opening; and an alignment assembly configured to guide passage of the groove therealong during movement of the circuit board in an insertion direction.

14. The cable interconnect system of claim 13 wherein:

the male connector comprises a locking assembly comprising a lock member and a release assembly; and a top wall of the plurality of walls of the rear assembly has a plurality of apertures formed therein configured to engage the locking assembly to secure the male connector to the connector bezel.

15. The cable interconnect system of claim 13, wherein:

the groove is aligned with the female connector; and the female connector is positioned within the cable connector opening when the groove is engaged with the alignment assembly.

16. The cable interconnect system of claim 13 wherein the female connector lacks locking elements configured to secure the female connector to the connector bezel.

17. The cable interconnect system of claim 13 wherein the electrical cable is a Serial-Attached Small Computer System Interface cable.

18. A connector bezel configured to guide engagement of a male mating connector of a cable with a female mating connector, the connector bezel comprising:

a front plate having a main opening formed therein configured to allow passage of the male mating connector therethrough; and a rear assembly attached to the front plate, the rear assembly comprising:

a plurality of walls forming a cable connector opening therethrough, wherein:

the plurality of walls comprises a divider wall positioned between a pair of side walls; and the divider wall separates the cable connector opening into at least two portions, each portion configured to allow passage of a respective male mating connector therethrough; and a rear opening configured to allow passage of the female mating connector therethrough;

wherein the cable connector opening is fluidly coupled with the main opening and with the rear opening.

19. A method of manufacturing a connector bezel, the method comprising:

forming a main opening in a front plate, the main opening configured to allow passage of the male mating connector therethrough;

attaching a plurality of walls to the front plate, the plurality of walls forming a cable connector opening fluidly coupled with the main opening;

forming a rear opening configured to allow passage of a female mating connector therethrough, the rear opening fluidly coupled with the cable connector opening; and attaching a beveled wall to the plurality of walls, the beveled wall configured to guide the female mating connector toward the cable connector opening.

20. A method of manufacturing a connector bezel, the method comprising:

forming a main opening in a front plate, the main opening configured to allow passage of the male mating connector therethrough;

attaching a plurality of walls to the front plate, the plurality of walls forming a cable connector opening fluidly coupled with the main opening;

forming a rear opening configured to allow passage of a female mating connector therethrough, the rear opening fluidly coupled with the cable connector opening; and attaching a plurality of ribs to the front plate and to the plurality of walls, the plurality of ribs configured to stabilize the front plate with respect to the plurality of walls.

21. A method of manufacturing a connector bezel, the method comprising:

forming a main opening in a front plate, the main opening configured to allow passage of the male mating connector therethrough;

attaching a plurality of walls to the front plate, the plurality of walls forming a cable connector opening fluidly coupled with the main opening;

forming a rear opening configured to allow passage of the female mating connector therethrough, the rear opening fluidly coupled with the cable connector opening; and attaching an alignment assembly to a bottom wall of the plurality of walls, the alignment assembly configured to guide passage of a circuit board groove therealong.

* * * * *